US008926040B2

(12) United States Patent
Matsumura et al.

(10) Patent No.: US 8,926,040 B2
(45) Date of Patent: Jan. 6, 2015

(54) PRINTING DEVICE AND PRINTING METHOD

(71) Applicant: Seiko Epson Corporation, Tokyo (JP)

(72) Inventors: Tetsuya Matsumura, Nagano (JP); Naoki Sudo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/202,326

(22) Filed: Mar. 10, 2014

(65) Prior Publication Data

US 2014/0292850 A1 Oct. 2, 2014

(30) Foreign Application Priority Data

Mar. 29, 2013 (JP) ..... 2013-071629

(51) Int. Cl.
*B41J 29/38* (2006.01)
*B41J 2/045* (2006.01)

(52) U.S. Cl.
CPC ..... *B41J 2/04541* (2013.01)
USPC ..... 347/9; 347/14; 347/12; 347/40

(58) Field of Classification Search
USPC ..... 347/5, 9, 12, 13, 14, 19, 40, 42, 44, 47
See application file for complete search history.

(56) References Cited

U.S. PATENT DOCUMENTS 7,828,400 B2 * 11/2010 Ikegame ..... 347/42
8,540,331 B2 9/2013 Fujimoto

FOREIGN PATENT DOCUMENTS

JP 2009-000836 A 1/2009
JP 2009-149064 A 7/2009

* cited by examiner

*Primary Examiner* — Juanita D Jackson
(74) *Attorney, Agent, or Firm* — Global IP Counselors, LLP

(57) ABSTRACT

In a printing device, a print medium is transferred in a sub-scanning direction, a print head is reciprocately driven in a main scanning direction, a plurality of nozzles for ejecting same color ink in the sub-scanning direction are provided on the print head to form a nozzle array, pairs of nozzle arrays of a plurality of colors are arranged in the main scanning direction so as to be in a symmetrical sequence relative to the main scanning direction, and nozzle data for ejecting the ink at each nozzle in each nozzle array is created to perform printing. The printing device includes an inclination information acquisition part configured to obtain inclination information on an inclination of the nozzle array with respect to the sub-scanning direction, and a nozzle data allocation changing part configured to change the nozzle data to be allocated for each nozzle based on the inclination information.

10 Claims, 8 Drawing Sheets

IN CASES WHERE THE HEAD IS INCLINED
(UPWARDLY INCLINING TO THE RIGHT, NO REVERSING OF A#2 AND H#1)

IN CASES WHERE THE HEAD IS INCLINED
(DOWNWARDLY INCLINING TO THE RIGHT, NO REVERSING OF A#2 AND H#1)

PRINTING DEVICE AND PRINTING METHOD

CROSS-REFERENCE TO RELATED APPLICATIONS

This application claims priority to Japanese Patent Application No. 2013-071629 filed on Mar. 29, 2013. The entire disclosure of Japanese Patent Application No. 2013-071629 is hereby incorporated herein by reference.

BACKGROUND

1. Technical Field

The present invention relates to a printing device in which color ink nozzle arrays are arranged left-right symmetrically and a printing method.

2. Related Art

In cases where a number of nozzles are formed on a print head in lines, if a print head is mounted in an inclined manner with respect to its original mounting position, the landing position will be displaced from the originally assumed position. As an example of the countermeasures, what are disclosed in Japanese Unexamined Laid-open Patent Application Publication No. 2009-000836 and Japanese Unexamined Laid-open Patent Application Publication No. 2009-149064 are known.

What are disclosed in the above mentioned publications are directed to a displacement in the so-called main scanning direction as a displacement of the landing position, and utilize the data of the position displaced in the main scanning direction to land at the displaced position, assuming that the landing position will be displaced in the main scanning direction.

SUMMARY

What are disclosed in the above mentioned publications are directed to a displacement of the landing position in the main scanning direction. However, in the case of a print head in which color inks are arrayed left-right symmetrically, printing is performed using the same color nozzle arrays arrayed left-right symmetrically. At this time, if the print head is mounted in an inclined state, the inclination to the main scanning direction causes a positional displacement in the sub-scanning direction. As a result, the same color nozzle arrays arrayed left-right symmetrically will be displaced in the sub-scanning direction. In cases where the nozzle arrays which should be arrayed in a zigzag manner on different levels with each other are arrayed left-right symmetrically, normally, nozzles of one of nozzle arrays should be positioned between nozzles of the other nozzle arrays. It, however, occurs that nozzles of both the nozzle arrays are positioned in the same line or that the original alignment sequence in the sub-scanning direction is reversed.

The present invention prevents deterioration of printing quality due to a displacement of a landing position even in cases where a print head having the so-called color ink arrays arrayed left-right symmetrically is mounted in an inclined manner.

In a printing device according to one aspect, a print medium is transferred in a sub-scanning direction, a print head is reciprocately driven in a main scanning direction intersecting with the sub-scanning direction, a plurality of nozzles for ejecting same color ink in the sub-scanning direction are provided on the print head to form a nozzle array, pairs of nozzle arrays of a plurality of colors are arranged in the main scanning direction so as to be in a symmetrical sequence relative to the main scanning direction, and nozzle data for ejecting the ink at each nozzle in each nozzle array is created to perform printing. The printing device includes an inclination information acquisition part configured to obtain inclination information on an inclination of the nozzle array with respect to the sub-scanning direction, and a nozzle data allocation changing part configured to change the nozzle data to be allocated for each nozzle based on the inclination information.

More specifically, the nozzle data allocation changing part changes the nozzle data to be allocated to each nozzle corresponding to the positional displacement of each nozzle in the sub-scanning direction of a paired nozzle array of the same color.

In the printing device used in the above aspect, as a basic structure, a print medium is transferred in a sub-scanning direction and a print head is reciprocately driven in a main scanning direction that intersects with the sub-scanning direction. Furthermore, a plurality of nozzle arrays for ejecting the same color ink in the sub-scanning direction are provided to form the nozzle arrays, and in the main scanning direction, pairs of nozzle arrays of a plurality of colors are arranged to be in symmetrical sequence in the main scanning direction. The nozzle arrays of so-called color ink are arranged so as to form a left-right symmetrical pair, and printing is performed by creating nozzle data to eject ink from each nozzle in each nozzle array.

Then, when the inclination information acquisition part obtains the inclination information of the nozzle array in the sub-scanning direction, the nozzle data allocation changing part changes the nozzle data to be allocated for each nozzle based on the inclination information and changes the nozzles to be used. For example, based on the inclination information, the nozzle data to be allocated to each nozzle is changed corresponding to the positional displacement of each nozzle in the sub-scanning direction of a matching nozzle array of the same color. In other words, in a nozzle array arranged in a paired manner in which a print head is inclined, when the nozzle arrays are compared, one of the nozzle arrays is relatively arranged front and back in the sub-scanning direction of the other nozzle array. The alignment sequence in the sub-scanning direction of the nozzles changes according to the degree of the back and forth arrangement. The change in the alignment sequence can be estimated in advance by the degree of the inclination and the measurement of the print head. Therefore, based on the information on the inclination, the nozzle data is changed so as to cancel the change in an alignment sequence of each nozzle in the sub-scanning direction caused by the displacement of each nozzle array in the sub-scanning direction, arranged symmetrically and having the same color. When the nozzle data is supplied in a sequence according to the alignment sequence of the sub-scanning direction, there will be no effect from the inclination since it does not manner which nozzle made the ejection and ink lands at an original estimated landing position.

In the printing device and the printing method of the above aspect, since the nozzle data is changed based on the inclination information to cancel the change in the alignment sequence in the sub-scanning direction caused by the displacement of the symmetrically arranged same color nozzle arrays in the sub-scanning direction due to an inclination, the effects of the inclination can be essentially cancelled, since the ink can land at its originally assumed landing position regardless of which nozzle it was ejected from.

BRIEF DESCRIPTION OF THE DRAWINGS

Referring now to the attached drawings which form a part of this original disclosure.

DETAILED DESCRIPTION OF EXEMPLARY EMBODIMENTS

Embodiments of the present invention will be explained with reference to drawings.

Figure 1:
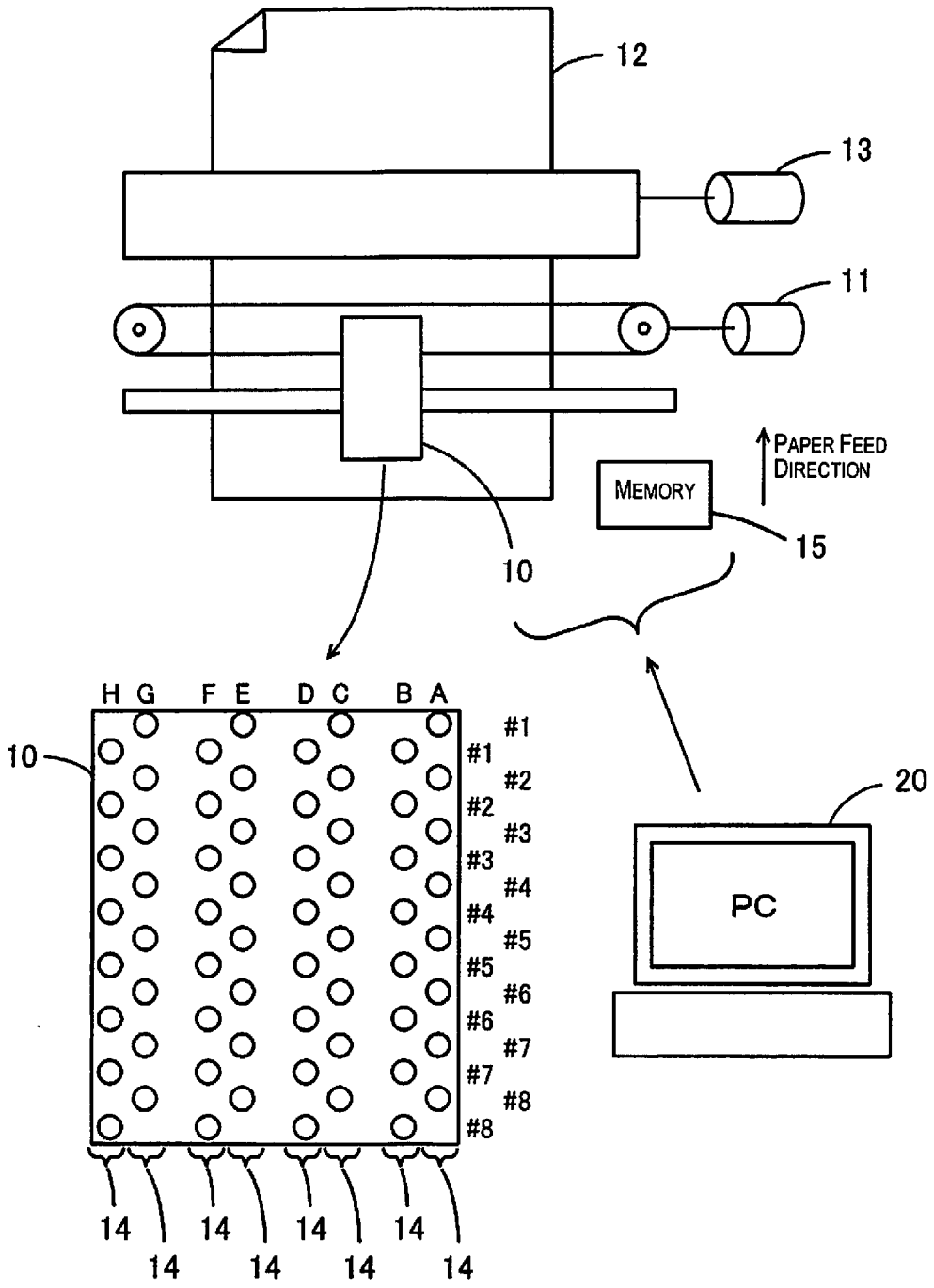
FIG. 1 is a schematic structural view showing an ink jet printer used in the present invention.

FIG. 1 is a schematic structural view showing an ink jet printer used in the present invention. Based on the drawings, a print head and the driving direction thereof will be explained.

The print head 10 is reciprocately driven as needed in a widthwise direction which is approximately perpendicular to (intersects with) the paper feeding (transferring) direction of the print medium 12. The platen motor 13 feeds a print medium 12 by a predetermined amount in the lengthwise direction at a predetermined timing. The driving direction of the carriage motor 11 in a widthwise direction is a main scanning direction and the driving direction of the platen motor 13 in a lengthwise direction is a sub-scanning direction. Further, although a control circuit, etc., are not illustrated, a nonvolatile memory 15 capable of recording data corresponding to individual structure is mounted. Furthermore, the individual members in the drawing are illustrated only at general positions and in reality, these members are arranged arbitrarily in different positions as required.

The print head 10 is provided with a plurality of nozzle arrays 14 arranged in the main scanning direction, in which a plurality of nozzles are provided in the sub-scanning direction. In the nozzle arrays 14, four pairs of two nozzle arrays arrayed in a zigzag manner on different levels with each other along the sub-scanning direction, are provided. For the convenience of explanation, each nozzle array 14 of the eight total arrays is provided with eight nozzles along in the sub-scanning direction and individual nozzles are identified by #1 to #8 counting from the downstream side of the print medium 12. Also, the nozzle arrays 14 are identified as A to H arrays from the right side to the left side of the drawing, that is, in a direction from the standby position of the print head 10 to the first main scanning direction.

In the eight nozzle arrays 14 (A to H arrays), yellow ink, cyan ink, magenta ink, black ink, black ink, magenta ink, cyan ink, and yellow ink are supplied in this order. That is, since the yellow ink is supplied to the A array and the H array of the nozzle array 14, the cyan ink is supplied to the B array and the G array of the nozzle array 14, the magenta ink is supplied to the C array and the F array of the nozzle array 14, and the black ink is supplied to the D array and the E array of the nozzle array 14, a nozzle array 14 corresponding to these four colors are prepared as a corresponding pair to which the same color ink is supplied. Therefore, in the main scanning direction, pairs of nozzle arrays 14 of plural colors are arranged so as to form a symmetrical sequence in the main scanning direction. The sequence of color ink is not limited to the aforementioned sequence and the color ink is not required to be limited to yellow ink, cyan ink, magenta ink and black ink, and can be a combination of other color ink.

The A and B arrays in the nozzle array 14, the C and D arrays in the nozzle array 14, the E and F arrays in the nozzle array 14, and the G and H arrays in the nozzle array 14 are pairs arranged in a zigzag manner with each other, in which the right array is arranged upwardly inclining to the downstream side on paper. On the other hand, because different color colored ink is supplied for each array, the yellow ink pair is arranged upwardly inclining to the right side, the cyan ink pair is arranged downwardly inclining to the right side, the magenta ink pair is arranged upwardly inclining to the right side, and the black ink pair is arranged downwardly inclining to the right side. The difference between whether a pair of nozzle arrays 14 incline upwards or downwards to the right is affected by whether the print head 10 itself inclines upwards to the right or downwards to the right as will be explained later. In the print head 10, each nozzle is provided by nozzle data for controlling whether or not to eject liquid droplets each nozzle, but a process to supply nozzle data to the print head 10 from a PC 20, etc., will be initially explained.

Figure 2:
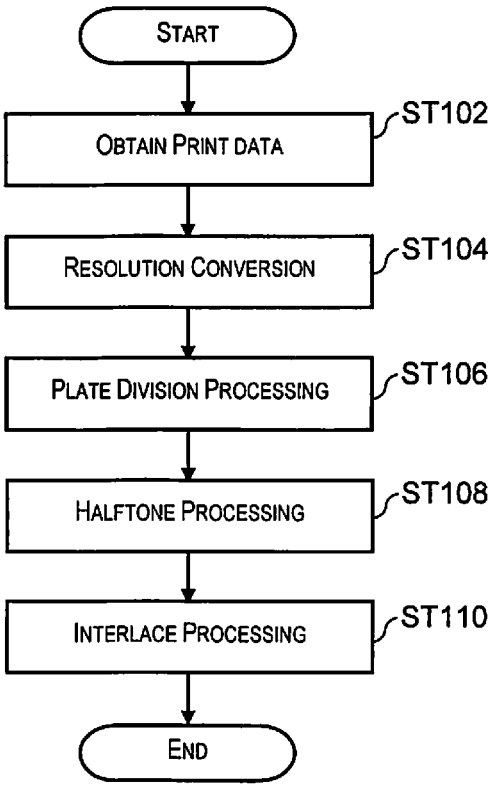
FIG. 2 is a flow chart showing the flow of the processes of the present invention.

FIG. 2 is a flowchart showing the flow of a process of creating raster data including the nozzle data from print data from a PC side.

The PC 20 obtains input image data in step ST102 and performs resolution conversion according to the resolution of an ink jet printer as the printing device in step ST104. In the next step ST106, the PC 20 performs a plate division processing from the RGB (red, green, blue) data to CMYK (cyan, magenta, yellow, black) corresponding to the ink colors. In the plate division processing, optimized CMYK print data is created for each print medium. At the time of the plate division of each color, the data is multi-gradation data. Therefore, in step ST108, a halftone processing is performed so as to be a binary value, or a bit value depending on the dot diameter in the case of a multi-dot size.

Next, since the halftone result is binary bitmap data such as a binary value corresponding to the resolution of the printing device, it is not specifically optimized for driving each nozzle array of the print head 10 while driving the print head 10 in the main scanning direction. Therefore, in step ST110, considering the paper feeding timing and/or the driving timing of the print head, the nozzle arrays 14 are controlled in each pass to create raster data for ejecting ink. This process is called interlace processing. Also, the raster data can be said to be a collection of nozzle data for controlling each nozzle of the nozzle arrays 14. Further, in the following, yellow ink is the same as Y ink, cyan ink is C ink, magenta ink is M ink, and black ink is K ink.

Figure 3:
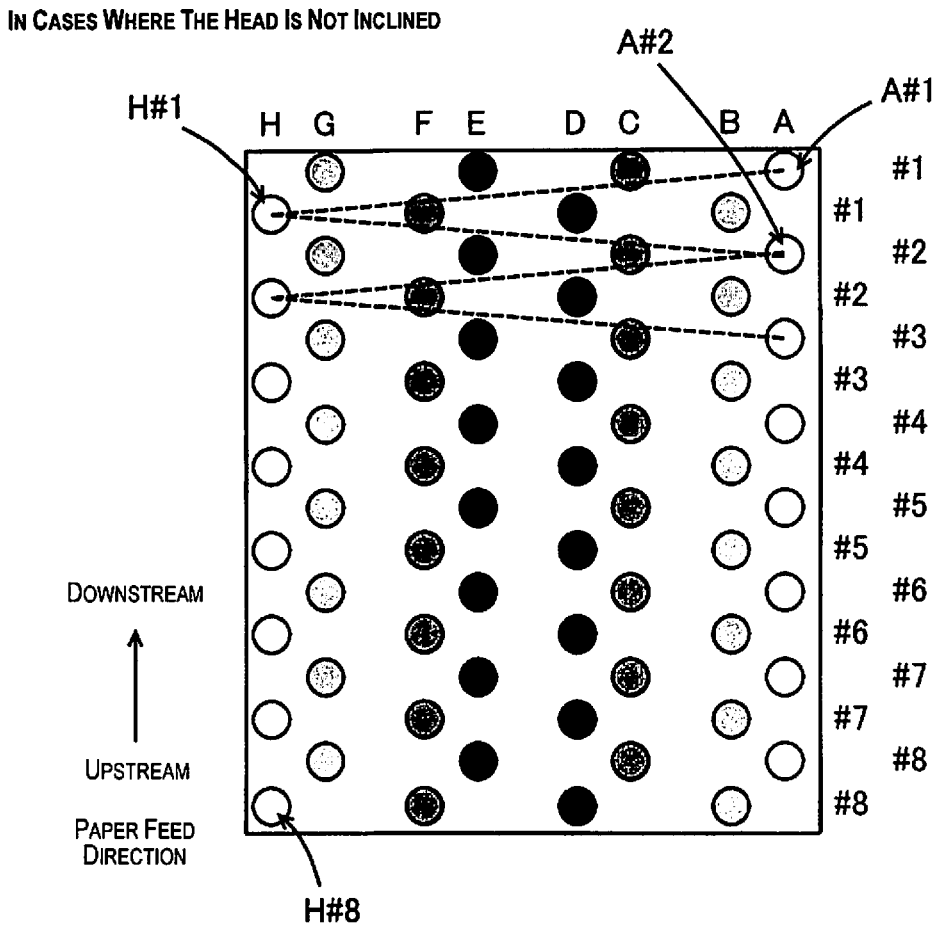
FIG. 3 is a schematic view showing a nozzle array of a print head with no inclination.

FIG. 3 shows a state in which the print head 10 is mounted to its original proper position without inclination. Although the paired nozzle arrays 14 are classified into two types, upwardly inclining to the right and downwardly inclining to the right, the nozzles are alternately aligned as an alignment sequence in the sub-scanning direction, since the pairs are aligned in a zigzag manner. Therefore, the proper alignment sequence from the downstream side in the sub-scanning direction is as follows.

The nozzles of the Y ink upwardly inclining to the right are:

A#1→H#1→A#2→H#2→A#3→ . . .
→H#7→A#8→H#8

The nozzles of the C ink downwardly inclining to the right are:

G#1→B#1→G#2→B#2→G#3→ . . .
→B#7→G#8→B#8

The nozzles of the M ink upwardly inclining to the right are:

C#1→F#1→C#2→F#2→C#3→ . . .
→F#7→C#8→F#8

The nozzles of K ink downwardly inclining to the right are:

E#1→D#1→E#2→D#2→E#3→ . . .
→D#7→E#8→D#8

Figure 4:
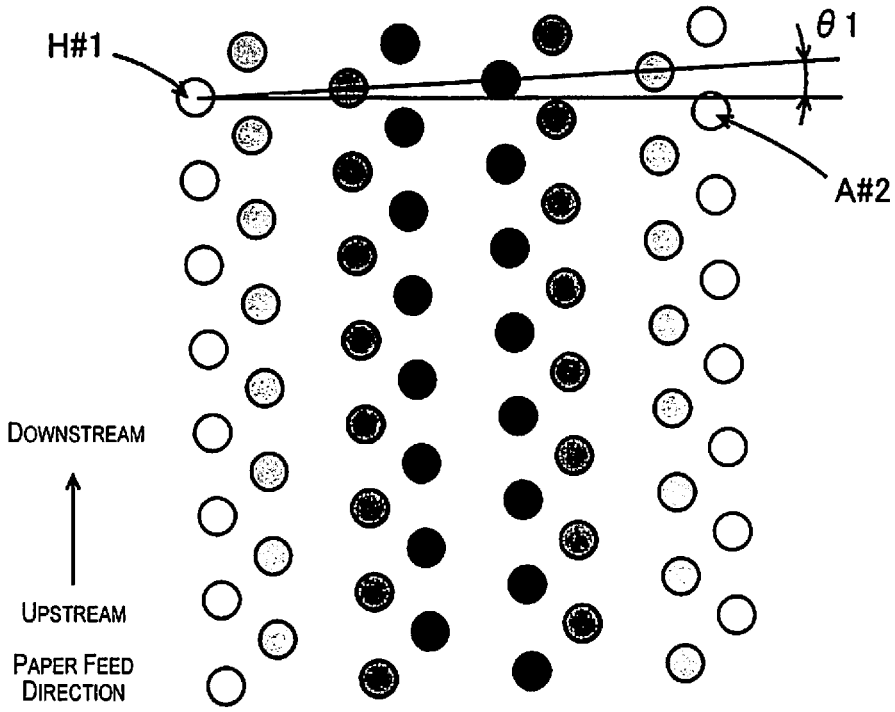
FIG. 4 is a schematic view showing a nozzle array of a print head upwardly inclining to the right side.

Next, FIG. 4 shows a case in which the print head 10 is inclined. Although the inclination is θ1 in the counterclockwise direction, an inspection of the alignment sequence from the downstream side shows that the nozzle A#2 is positioned more to the upstream side than the nozzle H#1 and is not reversed.

Figure 5:
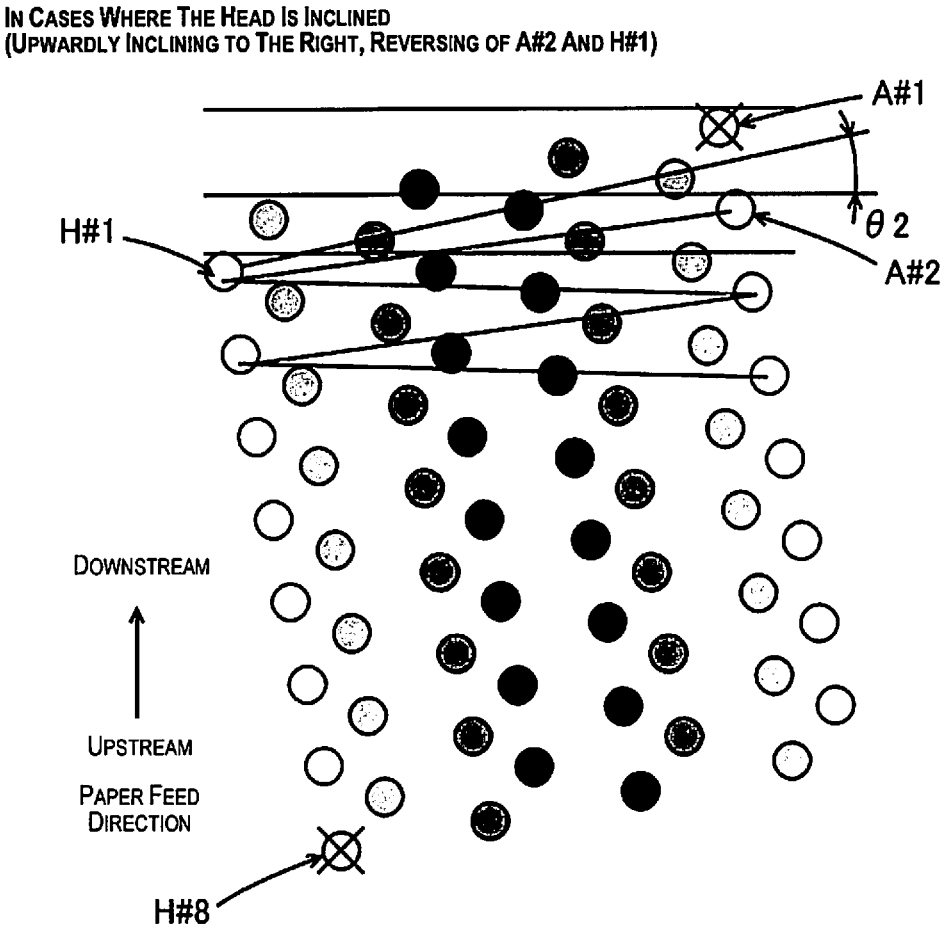
FIG. 5 is a schematic view showing a nozzle array of a print head upwardly inclining to the right side.

On the other hand, FIG. 5 shows a state in which the inclination of the print head 10 is θ2, which is larger than θ1. When the inclination to the counterclockwise direction in a right upward inclination becomes large, the nozzle A#2 is positioned more on the downstream side than the nozzle H#1, which in turn reverses the alignment sequence.

A more specific alignment sequence of the Y ink nozzles from the downstream side is:

A#1→A#2→H#1→A#3→H#2→A#4→ . . .
→H#6→A#8→H#7→H#8

In such alignment sequence, up to A#2→H#7, since the nozzles in the A and H arrays are aligned alternately, the interval between the nozzles when the sub-scanning direction is the standard is smaller than at least the intervals between the nozzles of the arrays. In other words, since the arrays are aligned in a zigzag manner, the intervals of the nozzles at the time of printing are closer, thereby exerting the effect of improving the resolution. However, since a nozzle of a paired nozzle array 14 does not exist between nozzles A#1 and A#2, and nozzles H#7 and H#8, the intervals between the nozzles of the arrays are as they are. Therefore, the arrays cannot be arranged in a zigzag manner to narrow the interval between the nozzles at the time of printing to exert the effect of improving the resolution.

In this way, when a paired nozzle arrays are aligned in a zigzag manner inclining upwards to the right, in a case in which the inclination to the right upward direction (counterclockwise direction) becomes larger and the alignment sequence has reversed, the nozzle on the most downstream side of the right array and the nozzle on the most upstream side of the left array cannot be used, so the use is limited.

Specifically, since the number of usable nozzles is reduced, when creating nozzle data from raster data, sequence nozzle data is allocated only to the usable nozzles from the downstream side, and the nozzle data corresponding to the unusable nozzles are left to be printed at the next main scanning. The point at which such reversal will occur at a degree of inclination can be determined in advance. Therefore, after obtaining the inclination using a direct or indirect method, a portion of the nozzle data is limited based on the inclination information to reduce the number of nozzles to be used.

Also, when not using the nozzles A#1 and H#8, since the nozzles A#2 to A#8 eject the liquid droplets that would have been ejected by the nozzles A#1 to A#7, the nozzle data that would have been supplied to the nozzles A#1 to A#7 needs to be allocated to the nozzles A#2 to A#8. That is, based on the inclination information, the nozzle data to be allocated to each nozzle is changed corresponding to the positional displacement of each nozzle in the sub-scanning direction of a matching nozzle array 14 of the same color. To correspond to the positional displacement means, in other words, to change the nozzle for allocation so that the alignment sequence of the nozzle data is maintained. Also, the nozzle data is changed so as to cancel the change in an alignment sequence of each nozzle in the sub-scanning direction from the shifting of each nozzle array in the sub-scanning direction, arranged symmetrically and having the same color.

Similar cases can occur with the M ink, which is the other color ink upwardly inclining to the right. However, the positional displacement distance in the sub-scanning direction is larger when it is positioned on the outside on the nozzle surface of the print head 10 even when the inclining angle is the same. Therefore, in the example as shown in FIG. 5, even when the reversion has occurred for the Y ink, there is no reversal for the M ink. In other words, the limitations on the nozzles to be used and the change in nozzle data based on the existence of the reversal has to be dealt individually for each colored ink in view of not only the inclination information but the distance with reference to the main scanning direction of the pairing nozzle arrays.

On the other hand, for the nozzles of the C ink downwardly inclining to the right, the nozzle B#1 is positioned more on the downstream side than the nozzle G#1, which in turn reverses the alignment sequence. A more specific alignment sequence of the C ink nozzle from the downstream side is:

B#1→G#1→B#2→G#2→B#3→ . . .
→G#7→B#8→G#8

In the case of a pair of nozzle arrays downwardly inclining to the right, an unusable nozzle does not suddenly occur. Instead, a position in which the sub-scanning direction of the left and right nozzle arrays is the standard reverses. In other words, the left array would have been positioned more on the downstream side, but the right array is positioned more on the downstream side. Further, in such specific method for changing the nozzle data to be allocated to the nozzles corresponding to positional displacement, the nozzle data to be allocated to the nozzle arrays of the same color and arranged symmetrically is alternately exchanged, and as a result, the nozzle data to be allocated to each nozzle is changed.

However, when the inclination of the print head 10 is small, the nozzles #B1 and #G1 may not reverse. Therefore, the changes to the nozzle data can be determined based on the inclination information as well as the right downward inclination and the distance between the pairing nozzle arrays.

Finally, reversal does not occur for the nozzles #D1 and #E1 of the K ink. The pair of nozzle arrays of the K ink is inclined downwardly to the right and can be considered to be similar to the case of the C ink. Also, when the inclination of the print head becomes larger and the nozzles #D1 and #E1 reverses, the alignment sequence is:

D#1→E#1→D#2→E#2→D#3→ . . .
→E#7→D#8→E#8

Therefore, the nozzle data allocated for each nozzle is changed so that the nozzle data to be allocated to the nozzles arrays of the same color as with the C ink is alternately exchanged.

In the process of producing nozzles of the print head 10, more than the required number of nozzles can be created for a nozzle array.

Figure 6:
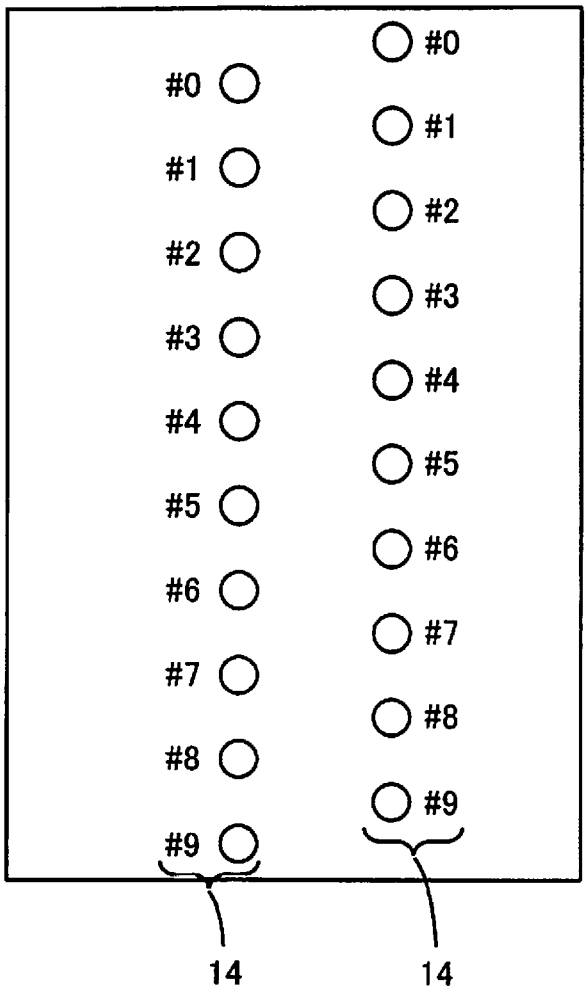
FIG. 6 is a schematic view showing a modified example of a print head.

FIG. 6 schematically shows a modified example of a print head.

In the case of the print head 10 shown in the figure, originally, ten nozzles #0 to #9 are produced for a pair of nozzle arrays, although only eight nozzles are required. And in a normal case with no inclination, the nozzles #1 to #8 are used in the left and right nozzle arrays. In other words, in this case, the nozzles #0 and #9 are limited for use in the left and right nozzle arrays.

However, when the upward inclination to the right becomes larger in a nozzle array of color ink upwardly inclining to the right as described above, and the use of the right array nozzles on the most downstream side is limited and the use of the left array nozzles on the most upstream side becomes limited, the following can be done. The following is not performed for a pair of adjacent nozzle arrays 14, but for symmetrical colored print head.

The nozzles with limited usage are placed in the right array and called #0 and #1, and no nozzles with limitations are provided in the left array. Also, for the nozzle data, the nozzle data allocated for the nozzles #1 to #8 in the right array is allocated for nozzles #2 to #9. For the left array, the nozzles #1 to #8 are used as originally used, and the use of nozzle #8 is not limited. As a result, there will be no nozzles with limitation in usage in the right and left arrays, and there will be no nozzle data that cannot be printed in one main scan.

In this case, the nozzle data to be allocated to the nozzles will be created based on the inclination information, rather than changing previously created nozzle data. The process is performed by the nozzle data allocation changing part.

The above explanation is summarized as follows:

In Case of Upward Inclination to the Right

1. In two nozzle arrays having the same color (in an ideal state with no inclination of the head), in a case in which the nozzle array on the right side is displaced to the downstream side (Y ink and M ink), when the reversal of the nozzles occurs, the nozzles to be used are limited, and print data is allocated to the usable nozzles.

2. In two nozzle arrays having the same color (in an ideal state with no inclination of the head), in a case in which the nozzle array on the left side is displaced to the downstream side (C ink and K ink), when the reversal of the nozzles occurs, the sequence of the print data to be allocated to the usable nozzles is changed.

3. Furthermore, when there are an excess number of nozzles, by adjusting the usage limited nozzle to change the nozzles to which the nozzle data is allocated, it is possible to not change the printing range.

Needless to say, the processing to perform the allocation corresponds to the nozzle data allocation changing part.

Figure 7:
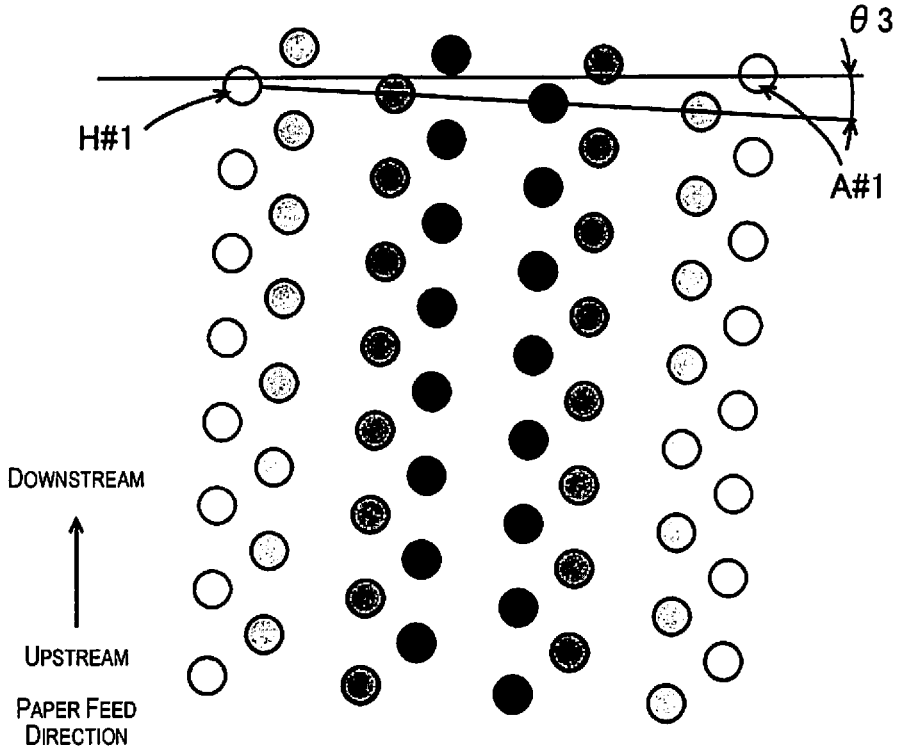
FIG. 7 is a schematic view showing a nozzle array of a print head downwardly inclining to the right side.

Next, FIG. 7 is a case in which the print head 10 is inclined downwardly to the right. Although the inclination is θ3 in the clockwise direction, an inspection of the alignment sequence from the downstream side shows that, for the Y ink, the nozzle A#1 is positioned more on the downstream side than the nozzle H#1 and is not reversed. Also, the C ink, the M ink, and the K ink are not reversed.

Figure 8:
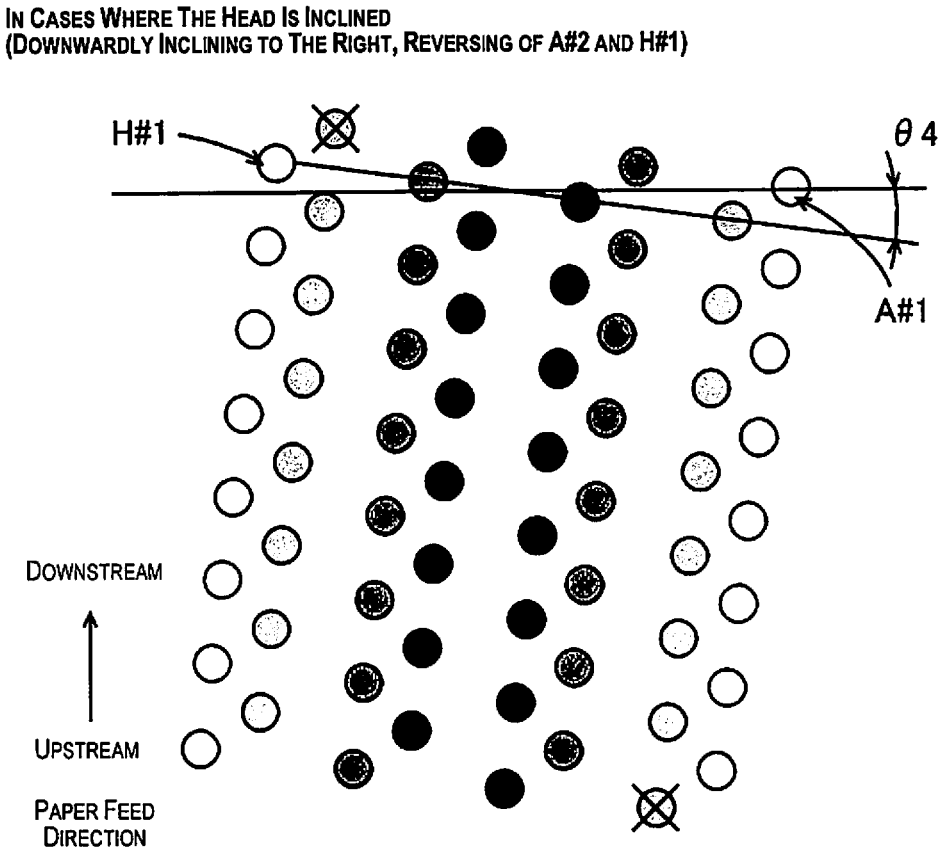
FIG. 8 is a schematic view showing a nozzle array of a print head downwardly inclining toward the right side.

On the other hand, FIG. 8 shows a state in which the inclination of the print head 10 is θ4, which is larger than θ3. In the following, the alignment sequence for each color from the downstream side will be examined.

The nozzles of Y ink are:

H#1→A#1→H#2→A#2→H#3→ . . .
→A#7→H#8→A#8

A similar reversing as in the case with the C ink as shown in FIG. 5 has occurred. Therefore, the nozzle data of the A array in the right array is mutually replaced with the nozzle data of the H array in the left array.

The nozzles of the C ink are:

G#1→G#2→B#1→G#3→B#2→G#4→ . . .
→B#6→G#8→B#7→B#8

A similar reversing (reversing of nozzles #G2 and #B1) as in the case of the Y ink as shown in FIG. 5 has occurred. Therefore, since the nozzles G#1 and B#8 cannot be used and the number of usable nozzles is reduced, the nozzle data is allocated to usable nozzles.

Reversal did not occur for the nozzles #F1 and #C1 of the M ink. However, when the inclination of the print head 10 becomes large and the nozzles #F1 and #C1 are reversed, the sequence becomes the following and a similar process as in the case of the Y ink will be performed:

F#1→C#1→F#2→C#2→F#3→ . . .
→C#7→F#8→C#8

Reversal did not occur for the nozzles #E2 and #D1 of the K ink. However, when the inclination of the print head 10 becomes large and the nozzles #E2 and #D1 are reversed, the sequence becomes the following and a similar process as in the case of the C ink will be performed:

E#2→D#1→E#3→D#2→E#4→ . . .
→D#6→E#8→D#7

Since the nozzles E#1 and D#8 cannot be used and the number of usable nozzles is reduced, the nozzle data is allocated to usable nozzles.

The above explanation is summarized as follows:

In Case of Downward Inclination to the Right

1. In two nozzle arrays having the same color (in an ideal state with no inclination of the head), in a case in which the nozzle array on the right side is displaced to the downstream side (Y ink and M ink), when the reversal of the nozzles occurs, the sequence of the print data to be allocated to the usable nozzles is changed.

2. In two nozzle arrays having the same color (in an ideal state with no inclination of the head), in a case in which the nozzle array on the left side is displaced to the downstream side (C ink and K ink), when the reversal of the nozzles occurs, the nozzles to be used are limited, and print data is allocated to the usable nozzles.

3. Furthermore, when there are an excess number of nozzles, the usage limited nozzles can be adjusted to change the nozzle to which the nozzle data is allocated, to thereby not change the printing range.

Needless to say, the processing to perform the allocation corresponds to the nozzle data allocation changing part.

An example in which pair nozzle arrays are arranged in a zigzag manner was explained above, but nozzle arrays that are not arranged in a zigzag manner can also be similarly applied. That is, the nozzle data to be allocated to nozzles can be changed so as to cancel the change in an alignment sequence of each nozzle in the sub-scanning direction from the displacement of each nozzle array in the sub-scanning direction due to the inclination of the print head whether or not the same color nozzle arrays arranged symmetrically are arranged in a zigzag manner.

The allocation of the nozzle data is done by the aforementioned interlace processing. The PC 20 reads the inclination information from the memory 15 in advance, determines whether or not it corresponds to any of the aforementioned examples according to the allocation of the colored ink in the print head 10 and the layout of the nozzle array and the nozzles, and performs the processing of changing the nozzle data corresponding to the arrays within the interlace processing.

Therefore, the process for the PC 20 to read the inclination information from the memory 15 in advance corresponds to the inclination information acquisition part.

Since the processing patterns for the change is limited, the inclination information and the patterns can be matched. A plurality of combinations of nozzle data to be allocated for nozzle arrays can be prepared. In this way, the processing can be completed by selecting one based on the inclination information and the process is simple.

Also, the inclination information of the print head 10 can be directly or indirectly measured in a state in which it is set up in the printing device, and the result can be recorded in a nonvolatile memory 15. A direct measurement means that the inclination angle is measured by a measurement device. Also, an indirect measurement means that a predetermined pattern is printed using the print head 10 and the inclination is detected using the print result. With the latter method, the inclination information can be obtained from a setup position of the user.

The above explanation was directed to a printing device using ink, but the concept of printing is not limited to the case in which letters and/or patterns are drawn on a paper using ink. The print medium can be various objects including a most basic paper, a resin sheet, a metal sheet, or a surface of a three-dimensional object, and the ink is not limited to an object for expressing colors and can be various kinds of liquids to be ejected to give any functions. Therefore, in the present invention, the printing device according to the present invention is used synonymously with various kinds of liquid droplet ejection devices, and the ink is used synonymously with various kinds of liquid droplets.

In the aforementioned example, the structure and functions as a printing device were mainly explained, but the structure and functions as a printing method were also explained by the disclosure of steps of the functions.

Needless to say, the present invention is not limited to the aforementioned example. For a person skilled in the art, it goes without saying that the followings are disclosed as one example of the present invention:

- arbitrarily changing the combination of the mutually replaceable material, structure, etc., disclosed in the example and applying;
- arbitrarily replacing the material, structure, etc., disclosed in the example with the material, structure, etc., which are not disclosed in the example, and are publicly known technology and mutually replaceable;
- arbitrarily replacing the material, structure, etc., disclosed in the example with the material, structure, etc., which are not disclosed in the example, but considered to be replaced with the material, structure, etc., based on a publicly known technology, etc., by the person skilled in the art.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device in which a print medium is transferred in a sub-scanning direction, a print head is reciprocately driven in a main scanning direction intersecting with the sub-scanning direction, a plurality of nozzles for ejecting same color ink in the sub-scanning direction are provided on the print head to form a nozzle array, pairs of nozzle arrays of a plurality of colors are arranged in the main scanning direction so as to be in a symmetrical sequence relative to the main scanning direction, and nozzle data for ejecting the ink at each nozzle in each nozzle array is created to perform printing, the printing device comprising:

an inclination information acquisition part configured to obtain inclination information on an inclination of the nozzle array with respect to the sub-scanning direction; and a nozzle data allocation changing part configured to change the nozzle data to be allocated for each nozzle based on the inclination information.

2. The printing device as recited in claim 1, wherein the nozzle data allocation changing part is configured to change the nozzle data to be allocated to each nozzle corresponding to a positional displacement of each nozzle in the sub-scanning direction of the nozzle arrays of the same color to be paired based on the inclination information.

3. The printing device as recited in claim 1, wherein the nozzles of each nozzle array arranged symmetrically and having the same color are arranged in a zigzag manner.

4. The printing device as recited in claim 1, wherein the nozzle data allocation changing part is configured to change the nozzle data to be allocated to each nozzle by alternately switching the nozzle data to be allocated to each nozzle array arranged symmetrically and having the same color based on the inclination information.

5. The printing device as recited in claim 1, wherein more nozzles are provided for the nozzle array than a number of nozzles to which the nozzle data corresponds, and the nozzle data allocation changing part is configured to change the nozzle to be used based on the inclination information to change the nozzle data to be allocated to each nozzle.

6. The printing device as recited in claim 1, wherein the nozzle data allocation changing part is configured to reduce the nozzles to be used by limiting a portion of the nozzle data based on the inclination information.

7. The printing device as recited in claim 1, wherein based on the inclination information, the nozzle data allocation changing part is configured to change the nozzle data so as to cancel a change in an alignment sequence of each nozzle in the sub-scanning direction caused by a displacement in the sub-scanning direction of each nozzle array of the same color arranged symmetrically.

8. The printing device as recited in claim 1, wherein the nozzle data allocation changing part is provided with a plurality of combinations of the nozzle data to be allocated to each nozzle array and configured to select one of the combinations based on the inclination information.

9. The printing device as recited in claim 1, wherein the nozzle data allocation changing part is configured to create the nozzle data to be allocated to each nozzle based on the inclination information rather than changing previously created nozzle data.

10. A printing method in which a print medium is transferred in a sub-scanning direction, a print head is reciprocately driven in a main scanning direction intersecting with the sub-scanning direction, a plurality of nozzles for ejecting same color ink in the sub-scanning direction are provided on the print head to form a nozzle array, pairs of nozzle arrays of a plurality of colors are arranged in the main scanning direction so as to be in a symmetrical sequence relative to the main scanning direction, and nozzle data for ejecting the ink at each nozzle in each nozzle array is created to perform printing, the printing method comprising:

obtaining inclination information on an inclination of the nozzle array with respect to the sub-scanning direction; and changing the nozzle data to be allocated to each nozzle based on the inclination information.

* * * * *